US006756932B1

(12) United States Patent
Barker et al.

(10) Patent No.: US 6,756,932 B1
(45) Date of Patent: Jun. 29, 2004

(54) MICROWAVE ABSORBING MATERIAL

(75) Inventors: Delmar L. Barker, Tucson, AZ (US); Stephen M. Schultz, Spanish Fork, UT (US); Harry A. Schmitt, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/459,022

(22) Filed: Jun. 10, 2003

(51) Int. Cl.[7] ..... H01Q 17/00

(52) U.S. Cl. ..... 342/4; 342/1

(58) Field of Search ..... 342/1–4

(56) References Cited

U.S. PATENT DOCUMENTS 4,906,998 A * 3/1990 Shibuya
5,016,015 A * 5/1991 Novak et al.
5,317,058 A * 5/1994 Dougherty et al.

OTHER PUBLICATIONS

Sievenpiper, Dan et al., "High–Impedance Electromagnetic Surfaces with a Forbidden Frequency Band", *IEEE Transactions on Microwave Theory and Techniques*, vol. 47, No. 11, Nov. 1999, pp. 2059–2074.

Notomi, M., "Theory of Light Propagation in Strongly Modulated Photonic Crystals: Refractionlike Behavior in the Vicinity of the Photonic Band Gap", The American Physcial Sciety, *Physical Review B*, Nol. 62, No. 16, Oct. 15, 2000, pp. 10 696–10 705.

Author Uncredited, "Trapping Light", *Discover*, Apr. 2001, pp. 72–79.

Fitzgerald, Richard, "Novel Composite Medium Exhibits Reversed Electromagnetic Properties", American Institute of Physics, *Physics Today*, May 2000, pp. 17–18.

Veselago, V.G., et al., "The Electrodynamics of Substances with Simultaneously Negative Values of $\epsilon$ and $\mu$", *Soviet Physics USPEKHI*, Trans. W. H. Furry, vol. 10, No. 4, Jan.–Feb. 1968, pp. 509–514.

Shelby, R.A., et al., "Reversal of Snell's Law: Experimental Verification of Negative Refraction", Preprint, Submitted to *Science* Jan. 5, 2001, unpaginated for publication.

Smith, D.R., et al., "A Composite Medium with Simultaneously Negative Permeability and Permittivity", The American Physical Society, *Physical Review Letters*, vol. 84, No. 18, May 1, 2000, pp. 4184–4187.

Pendry, J. B., et al., "Magnetism from Conductors and Enhanced Nonlinear Phenomena", *IEEE Transactions on Microwave Theory and Techniques*, vol. 47, No. 11, Nov. 1999, pp. 2075–2084.

(List continued on next page.)

*Primary Examiner*—Ian J. Lobo
(74) *Attorney, Agent, or Firm*—David W. Collins; Thomas J. Finn; Philip P. Berestecki

(57) ABSTRACT

A method of absorbing microwave radiation is provided. The method comprises placing a structure in the path of the microwave radiation, the structure comprising an array of metal plates supported over a metal substrate by vertical conducting vias. The structure finds specific use in missiles having a dome portion that operates in a stealth mode. At least the inside of the dome portion is provided with the above-described structure for absorbing microwave radiation. The structure also finds use in anechoic chambers for use in testing microwave-emitting devices. Such anechoic chambers have walls, a floor, and a ceiling, which are provided with the above-described structure for absorbing microwave radiation. Surface patterning is thus used to enhance the micro-wave absorption. In addition, the frequency over which the material is highly absorptive can be shifted by changing the height of the structure, thus allowing active control ("tunable in real time").

25 Claims, 4 Drawing Sheets

OTHER PUBLICATIONS

Shelby, R. A., et al., "Microwave Transmission Through a Two–Dimentional Isotropic, Left–handed Metamaterial", Preprint, Submitted to *Applied Physics Letters* Oct. 23, 2000, unpaginated for publication.

Sievenpiper, D. F., et al., "3D Metallo–Dielectric Photonic Crystals with Strong Capacitive Coupling between Metallic Islands", The American Physical Society, *Physical Review Letters*, vol. 80, No. 13, Mar. 30, 1998, pp. 2829–2831.

Author Uncredited, "Through the Looking Glass", *Discover*, Apr. 2002, pp. 19–20.

Smith, D. R., and Norman Kroll, "Negative Index in Left–Handed Materials", The American Physical Society, *Physical Review Letters*, vol. 85, No. 14, Oct. 2, 2000, pp. 2933–2936.

* cited by examiner

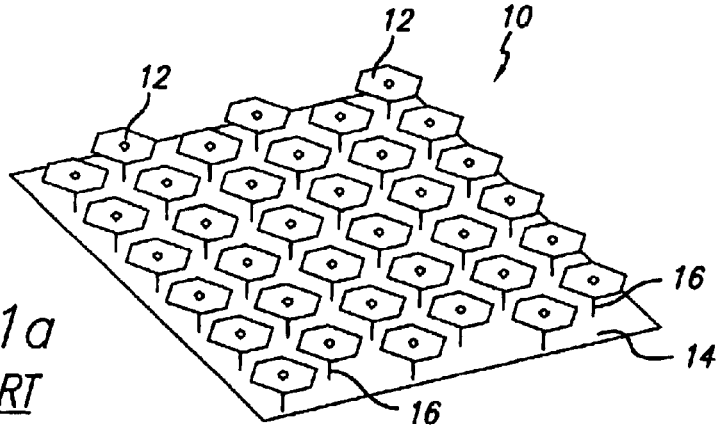
FIG. 1a
PRIOR ART
FIG. 1b
PRIOR ART
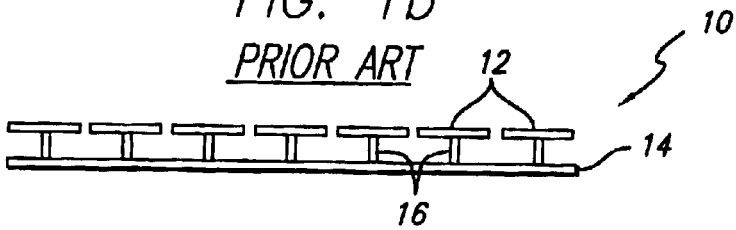
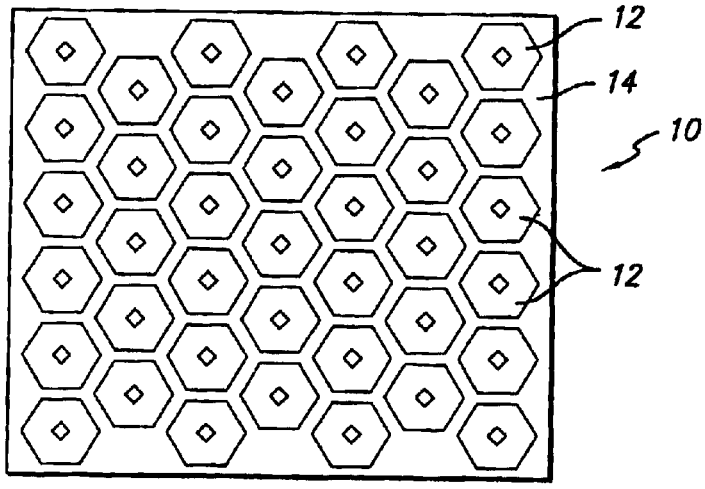
FIG. 1c
PRIOR ART FIG. 2
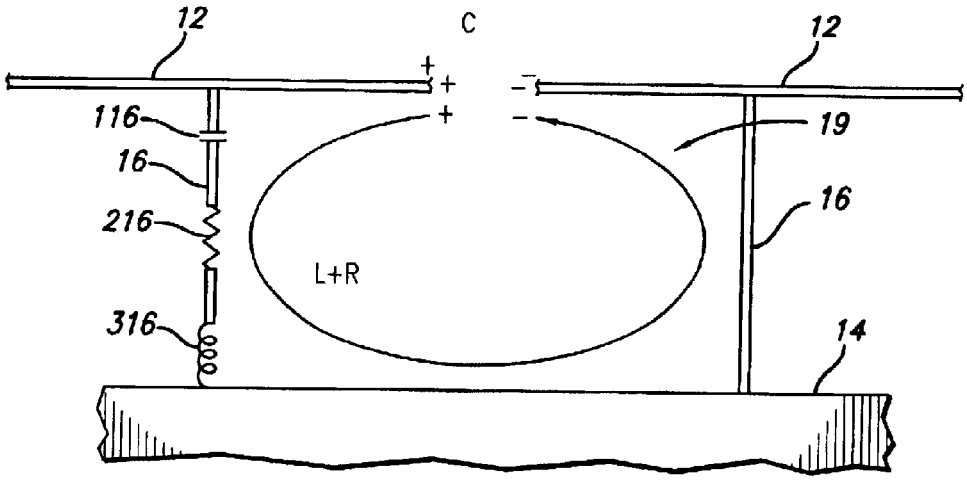
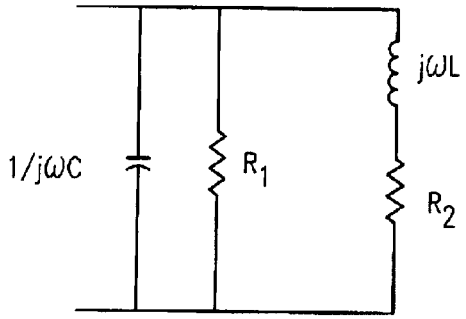
FIG. 3
PRIOR ART
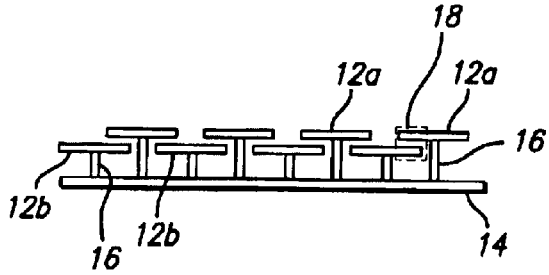
FIG. 4
PRIOR ART FIG. 5
PRIOR ART
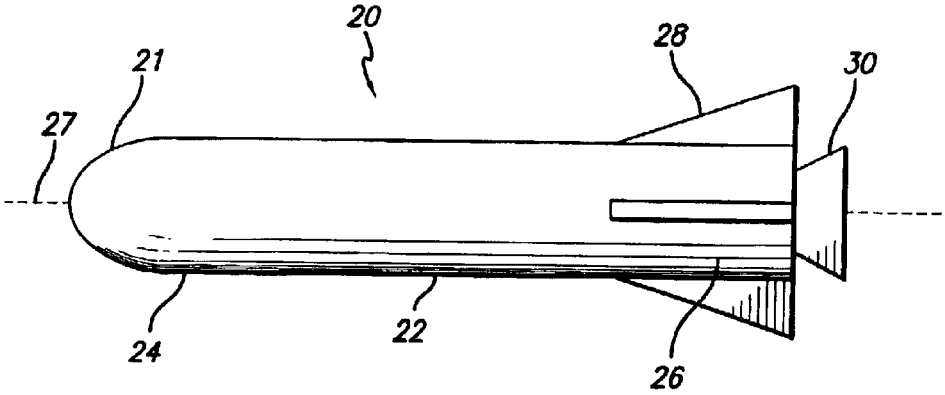
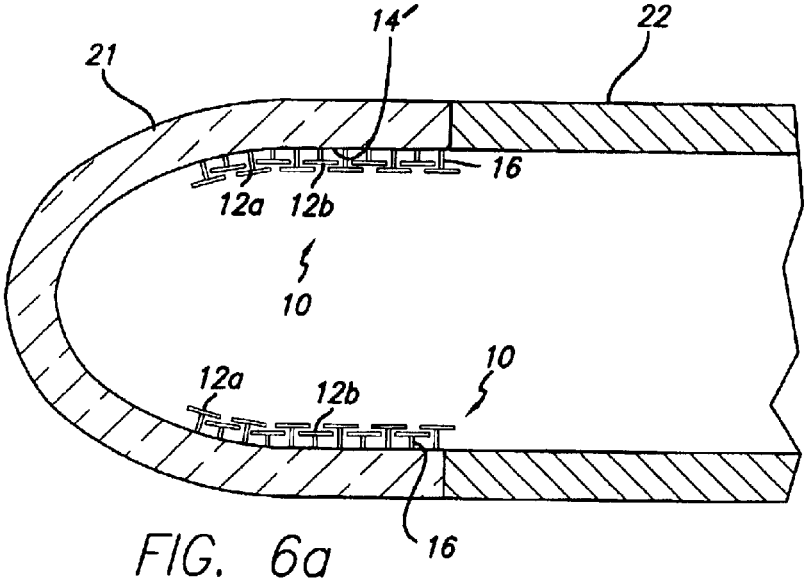
FIG. 6a

MICROWAVE ABSORBING MATERIAL

TECHNICAL FIELD

The present invention is directed generally to microwaves, and, more particularly, to materials employed for absorbing microwaves.

BACKGROUND ART

Microwave absorbing material is valuable in a variety of applications. The most notable applications include anechoic chamber walls and stealthy aircraft and missile skins.

The typical microwave absorbing materials used in anechoic chambers are ferrites and polystyrene. These materials are expensive and lack the strength to be used in aircraft and missile skins. Further, these materials have fixed ranges of operation and are not tunable.

Minimization of radar reflectivity is of varying importance in different kinds of military missions. Avoidance of detection is often a paramount consideration.

Varieties of approaches have been taken. One such approach discloses altering the construction of the aircraft as well as fabricating the shell of the aircraft from a rigid structural foam, which is filled with a microwave energy absorbing or dissipating material. Carbon or iron or nichrome are listed as possible fillers. See, e.g., U.S. Pat. No. 5,016,015, issued May 14, 1991, entitled "Aircraft Construction".

Another approach discloses chemical tuning to modify the microwave dielectric and/or magnetic properties of a microwave-absorbing material. The microwave-absorbing material comprises blends of polar icosahedral molecular units with a variety of host matrices, or with polymers with units covalently bonded in a pendant manner to the polymer chain. See, e.g., U.S. Pat. No. 5,317,058, issued May 31, 1994, entitled "Microwave-Absorbing Materials Containing Polar Icosahedral Units and Methods of Making the Same".

Finally, another area of use of microwave absorbable materials is in anechoic chambers. A problem in anechoic chambers is that reflections from the walls may interfere with the scattering results from the object under test.

Thus, there remains a need for a microwave-absorbing material that is relatively lightweight, is structurally sound, and exhibits a high absorption coefficient. Additionally, such material ideally should be tunable in real time.

DISCLOSURE OF INVENTION

In accordance with the present invention, a method of absorbing microwave radiation is provided. The method comprises placing a structure in the path of the microwave radiation, the structure comprising an array of metal plates supported over a metal substrate by vertical conducting vias.

Also in accordance with the present invention, a missile having a dome portion is provided that operates in a stealth mode. At least the inside of the dome portion is provided with the above-described structure for absorbing microwave radiation.

Further in accordance with the present invention, an anechoic chamber for use in testing microwave-emitting devices is provided. Such anechoic chambers have walls, a floor, and a ceiling. The walls, the floor, and the ceiling are provided with the above-described structure for absorbing microwave radiation.

The present invention uses surface patterning to enhance the microwave absorption. The cost can be reduced by using surface patterning rather than using more exotic materials. Furthermore, the material can be substantially stronger than was previously available using ferrite-based materials, thus allowing the absorbing material to be more easily integrated into the skins of aircraft and missiles. In addition, the frequency over which the material is highly absorptive can be shifted by changing the height of the structure, thus allowing active control ("tunable in real time"). A major immediate use of this material may well be for anechoic chamber walls, where the reduction of multiple reflections from the walls will improve the sensitivity of the measurements by reducing their interference with the scattering results from the object under test. It requires less volume to implement when compared to the conventional passive absorbers.

BRIEF DESCRIPTION OF THE DRAWINGS

FIG. 1*a* is a three-dimensional representation of a two-dimensional photonic crystal consisting of an array of raised metal plates, in accordance with the present invention;

FIG. 1*b* is a side elevational view of the structure shown in FIG. 1*a;*

FIG. 1*c* is a top plan view of the structure shown in FIG. 1*a;*

FIG. 2 is a schematic representation of the origin of a high impedance surface, including additional circuit and tuning elements;

FIG. 3 is a schematic circuit representing the equivalent circuit of the high impedance surface depicted in FIG. 2;

FIG. 4 is a side elevational view similar to that of FIG. 1*b*, but illustrating an alternate embodiment;

FIG. 5 is an elevational view of a conventional missile;

FIGS. 6*a* and 6*b* are each a schematic enlarged sectional view of the missile of FIG. 5, taken along line 6—6, depicting use of the microwave absorbing material of the present invention, with FIG. 6*a* depicting used of the microwave absorbing structures on the inside of the radome and FIG. 6*b* depicting use of the structures on the outside of the missile skin.

BEST MODES FOR CARRYING OUT THE INVENTION

Figure 6B:
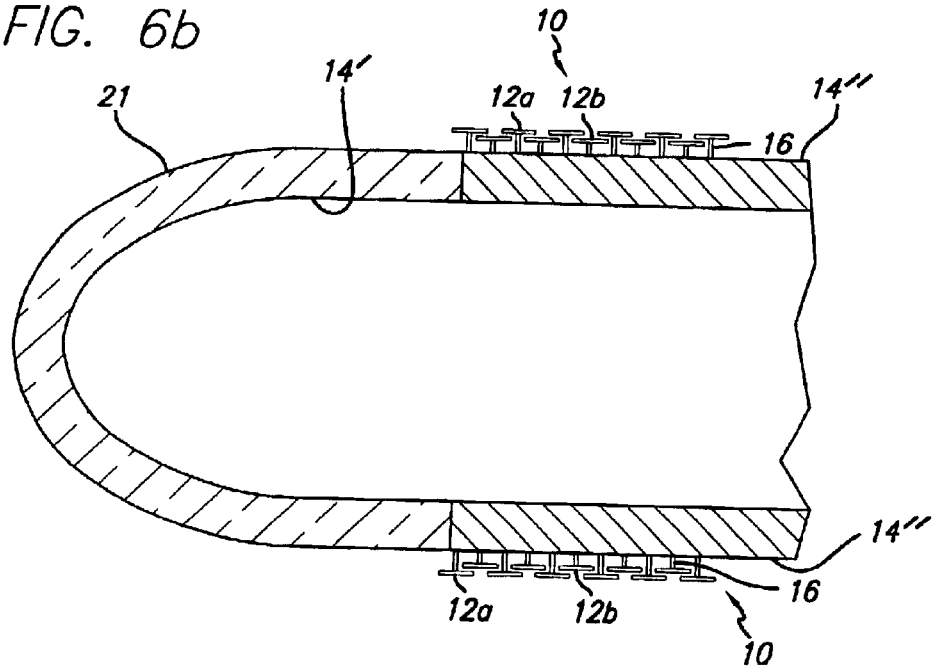

As is well-known, an electromagnetic wave incident on a surface is divided into a reflected and a transmitted wave. With a lossy surface, the transmitted wave is absorbed as it propagates. For the present invention, the material is thick enough to absorb all of the transmitted power. The required thickness to absorb a microwave or millimeter waves is thin. As used herein, the term "thin" with respect to the material thickness means a thickness on the order of a wavelength. This is to be contrasted with other prior art microwave absorbers, wherein "thin" usually refers to several wavelengths thick.

Since any power that is transmitted is absorbed, the material may be made to be highly absorptive by reducing the reflection coefficient. The reflection coefficient $\Gamma$ for a plane wave incident on a conductor is approximately given by $$\Gamma \cong \frac{\eta_2 - \eta_1}{\eta_2 + \eta_1}. \quad (1)$$

where $\eta_1$ and $\eta_2$ are the wave impedance respectively for the incident and transmitted regions and are given by $$\eta_1 = \sqrt{\frac{\mu_1}{\varepsilon_1}}, \quad (2)$$

for the dielectric incident region and $$\eta_2 = \sqrt{\frac{j\omega\mu_2}{\sigma_2 + j\omega\varepsilon_2}}, \quad (3)$$

for a conductor, where $\omega=2\pi f$, f is the frequency, $\epsilon$ and $\mu$ are respectively the permittivity and permeability, and $\sigma$ is the conductivity. The wave impedance for a conductor is small (since $\sigma_2$ is large), thus, producing a large reflection coefficient. Matching the wave impedance of the two regions reduces the reflection. To accomplish this, ferrites are typically used because they have a large permittivity and permeability and a lower conductivity resulting in a substantially lower reflection coefficient.

Rather than change the material properties (permittivity and permeability), the structure of the surface can be changed. The surface consists of a two-dimensional periodic structure that prevents the propagation of electromagnetic waves and is known as a 2D photonic crystal. FIGS. 1*a*–1*c* illustrate such a structure. Such structures have been disclosed as high-impedance surfaces, but not using metamaterials; see, e.g., D. Sievenpiper et al, "High-impedance Electromagnetic Surfaces with a Forbidden Frequency Band", *IEEE Transactions on Microwave Theory and Techniques*. Vol. 47, No. 11 (November 1999).

The structure 10 in FIGS. 1*a*–1*c* comprises a lattice of metal plates 12, each connected to a solid metal sheet 14 by vertical electrically conducting vias 16.

As long as the wavelength is much longer than the size of the individual features, the surface may be modeled using effective media. The surface impedance of the structure is determined by modeling the structure using equivalent circuit elements. FIG. 3 shows the resulting equivalent circuit that is derive from the geometry and materials. FIG. 2 shows the origin of the circuit elements. There are two loss elements associated with the surface. The first loss element involves loss associated with the fill material 19 and corresponds to the resistive element $R_1$ depicted in FIG. 3. The second loss element involves the finite conductivity of the metal top 12, vias 16, and substrate 14 and corresponds to resistive element $R_2$ depicted in FIG. 3. The gap in the conducting path results in charge build up and corresponds to the element C in FIG. 3. The possible current flow around the cell results in inductance depicted by L in FIG. 3. Furthermore, FIG. 2 shows discrete elements 116 (capacitor) and 216 (resistor) that can be added to structure to change the capacitance C and resistance $R_1$, respectively. An inductor (not shown) can be used to change the inductance L of the structure. The circuit elements can be advantageously incorporated in the conducting vias 16.

The resulting equivalent circuit is a resonant structure that depends on the frequency of the incident wave. The reflection coefficient is minimal when the impedance of the surface is equal to the impedance of the incident region. Since the incident region is entirely real, this requires the imaginary component of the surface impedance to be zero. This is referred to as the resonance of the surface.

There are two separate embodiments of the present invention in which one of the two losses is dominant. With the loss primarily in the dielectric material, the value of $R_2$ is taken to be zero, and the surface impedance is calculated to be $$\eta = \frac{\omega^2 R_1 L^2 + j\omega R_1^2 L(1 - \omega^2 LC)}{R_1^2(1 - \omega^2 LC) + \omega^2 L^2}. \quad (4)$$

The resonance is determined by setting the imaginary portion of the impedance equal to zero to yield $$\omega_0 = \sqrt{\frac{1}{LC}}, \quad (5)$$

and an impedance at resonance of $$\eta(\omega_0)=R_1. \quad (6)$$

With the loss primarily in the metal, the value of $R_1$ is taken to be infinite, and the surface impedance is calculated to be $$\eta = \frac{R_2 + j(\omega L - \omega^3 L^2 C - \omega R_2^2 C)}{(1 - \omega^2 LC)^2 + (\omega R_2 C)^2}, \quad (7)$$

which exhibits a resonance at $$\omega = \sqrt{\frac{1}{LC} - \frac{R_2^2}{L^2}}, \quad (8)$$

with an impedance of $$\eta(\omega_0) = \frac{L}{R_2 C}. \quad (9)$$

Each of the two embodiments produces a low reflectance when the impedance of the surface equals the impedance of the incident region, and thus a high absorption. There are advantages to each of the embodiments. As shown in Eqn. 6, with the loss primarily in dielectric, the resonance can be shifted by varying L and/or C without changing the impedance at resonance. This allows the resonant frequency to be shifted by moving the top metal surface with respect to the lower surface without changing the actual impedance value at resonance. With the loss primarily in the metal, the impedance at resonance can be made large without requiring a large resistance.

From the foregoing discussion, it will be readily apparent to those skilled in this art that any RLC (resistive-inductive-capacitive) circuit that has resistive elements for dissipating power and tunable to various wavelengths may be suitably employed in the practice of the present invention.

FIG. 4 depicts an alternate embodiment of a high impedance surface, comprising a three-layer high-impedance surface for achieving a lower operating frequency for a given thickness by using capacitive loading. A first layer of the surface is defined by the height of the metal plates 12*a*, and the second layer of the surface is defined by the height of the metal plates 12*b*. A capacitor 18 is formed by the overlap of adjacent metal plates 12*a*, 12*b*.

Further, the height of the metal plates 12 is adjustable by means of an adjusting element 316, such as a microelectromechanical system (MEMS) device in the conducting vias 16.

FIG. 5 depicts a vehicle, here illustrated as a missile 20, having a dome or radome 21 attached thereto. The dome 21 is forwardly facing as the missile flies and is therefore provided with a shape that achieves a compromise between good aerodynamic properties and good radiation transmission properties. The missile 20 has a missile body 22 with a forward end 24, rearward end 26, and a body axis 27. The missile body 22 is generally cylindrical, but it need not be perfectly so. Movable control fins 28 and an engine 30 (a rearward portion of which is visible in FIG. 5) are supported on the missile body 22. Inside the body of the missile are additional components that are not visible in FIG. 5, are well-known in the art, and whose detailed construction are not pertinent to the present invention, including, for example, a seeker having a sensor, a guidance controller, motors for moving the control fins, a warhead, and a supply of fuel.

FIG. 6 depicts a portion of the forward section of the missile 20 shown in FIG. 5, enlarged and in section. An array of structures 10 is provided on the inside surface 14' of the dome 21. The array of structures 10 serves to absorb microwaves and render the dome 21 "invisible" to radar. For placement of the structures 10 on the inside surface 14' of the dome 21, the dome would have to be configured such that the internal signal can leave the missile and then be tuned back to a blocking signal for reflecting the enemy signal.

For a missile body 22 made of metal, the array of structures 10 is ideally placed on the outside surface 14" of the missile 20.

While the foregoing description has been given in terms of a missile, it will be immediately apparent to those skilled in this art that the structures 10 may be used in a variety of airframes, including, but not limited to, both manned and unmanned aircraft skins.

Figure 7:
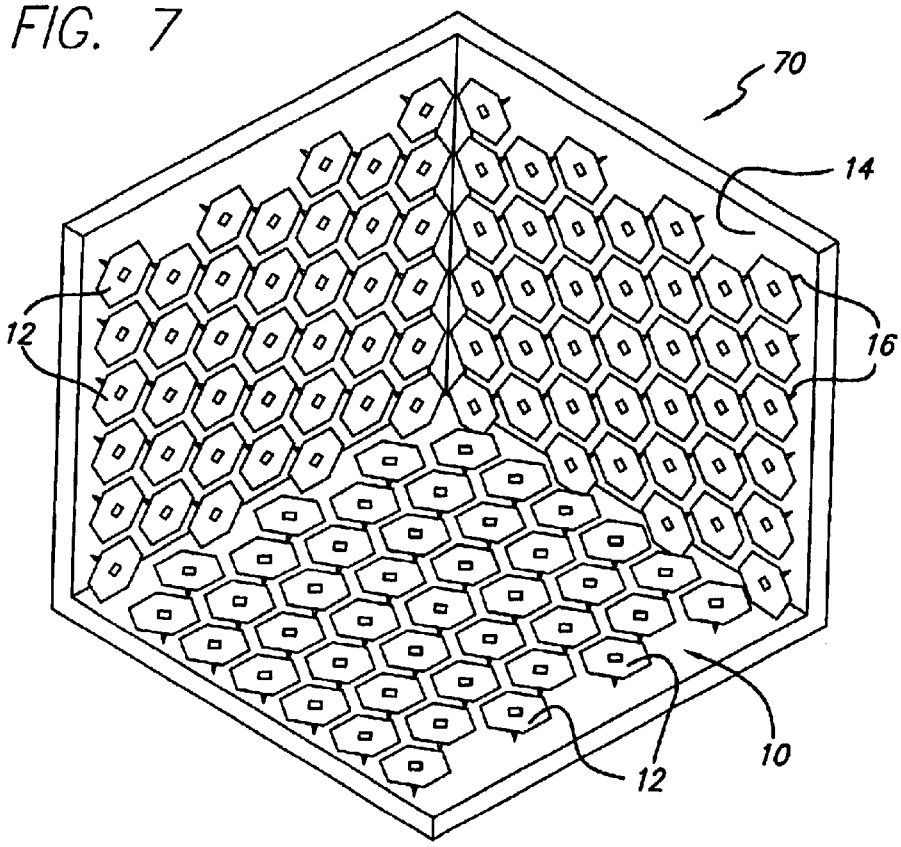
FIG. 7 is a perspective view of a portion of an anechoic chamber, showing the use of the structure of the present invention in such a chamber.

In an alternate embodiment for using the structures shown in FIGS. 1*a*–1*c* and 4, an anechoic chamber is provided with such structures 10 on its walls, ceiling, and floor. Such an anechoic chamber is used for testing radar scattering, and it is necessary that the reflections off the surfaces of the anechoic chamber do not interfere with the testing. FIG. 7 depicts a portion of such an anechoic chamber 70. The structure 10 is tunable by simply moving the plates 12 closer or further from the surface 14, as described above. An advantage of using the structures 10 in such an anechoic chamber 70 is that not as much space is required as with the conventional foam cones and the structures are not as delicate as the foam cones.

Thus, by using the composite structure of the present invention, to cover the walls of the anechoic chamber, one can improve the test chamber results. The reduction of multipath effects is particularly important for calibrating multi-channel antennas require for adaptive array processing.

In the embodiments discussed herein, the frequency range is on the order of 0.5 to 100 GHz. Resonance is a function of resistance, inductance, and capacitance, as discussed above. These parameters are controlled by setting the height of the structures, the separation between structures, the diameter of the vias, the particular materials, and the extent of overlap of structures in the three-layer configuration. In general, the heights and lengths for the vias 16 and plates 12 are each 1 to 10 times less than the wavelength of the radiation. In all cases, the height of the metal plates 12, 12*a*, 12*b* may be predetermined and fixed for a particular wavelength.

Calculating the height for a given wavelength depends on all of the parameters discussed above. This would require a detailed numerical simulation with a program such as HFSS. However, such simulations are readily within the ability of one skilled in this art. Alternatively, a mechanism (element 316 in FIG. 2), such as a conventional MEMS device, can be provided for selectively raising and lowering the height of the metal plates 12, 12*a*, 12*b* either jointly as one or independently.

In principle, any conducting material can be used in the practice of the present invention for the metal plates 12 and conducting vias 16. However, preferably, a metal is used.

INDUSTRIAL APPLICABILITY the microwave absorbing material disclosed herein is expected to find a variety of uses in, for example, missiles and anechoic chambers, where absorption of microwaves is desired.

What is claimed is:

1. A method of absorbing microwave radiation comprising placing a microwave absorbing structure in the path of the microwave radiation, the structure comprising an array of metal plates supported over a metal substrate by vertical conducting vias, wherein the vertical conducting vias are adjustable, to increase or decrease the height of the metal plates.

2. The method of claim 1 wherein the vertical conducting vias are of the same length, thereby providing the metal plates all at the same height.

3. The method of claim 1 wherein the array of metal plates comprises two sub-arrays, one sub-array being higher than the other sub-array.

4. The method of claim 3 wherein metal plates in one sub-array overlap metal plates in the other sub-array.

5. The method of claim 1 wherein the height of all of the metal plates is adjusted at the same time.

6. The method of claim 1 wherein the height of each metal plate is adjusted independent of other metal plates.

7. The method of claim 1 wherein adjacent metal plates form a resonant circuit therebetween.

8. The method of claim 7 wherein at least one circuit element selected from the group consisting of resistors, inductors, and capacitors is operatively associated with the metal plates to tune the resonant circuit.

9. The method of claim 8 wherein each circuit element is a part of the conducting vias.

10. A radar absorbing skin comprising a microwave absorbing structure in the path of the microwave radiation, the structure comprising an array of metal plates supported over a metal substrate by vertical conducting vias, wherein the vertical conducting vias are adjustable to increase or decrease the height of the metal plates.

11. The radar absorbing skin of claim 10 wherein the vertical conducting vias are of the same length, thereby providing the metal plates all at the same height.

12. The radar absorbing skin of claim 10 wherein the array of metal plates comprises two sub-arrays, one array being higher than the other.

13. The radar absorbing skin of claim 12 wherein metal plates in one sub-array overlap metal plates in the other sub-array.

14. The radar absorbing skin of claim 10 wherein the height of all of the metal plates is adjusted at the same time.

15. The radar absorbing skin of claim 10 wherein the height of each metal plate is adjusted independent of other metal plates.

16. The radar absorbing skin of claim 10 wherein adjacent metal plates form a resonant circuit therebetween.

17. The radar absorbing skin of claim 16 wherein at least one circuit element selected from the group consisting of resistors, inductors, and capacitors is operatively associated with the metal plates to tune the resonant circuit.

18. The radar absorbing skin of claim 17 wherein each circuit element is a part of the conducting vias.

19. An anechoic chamber for use in testing microwave-emitting devices, the anechoic chamber having walls, a floor, and a ceiling, the walls, the floor, and the ceiling provided with a structure for absorbing microwave radiation, the structure comprising an array of metal plates supported over a metal substrate by vertical conducting vias, wherein the vertical conducting vias are adjustable, to increase or decrease the height of the metal plates.

20. The anechoic chamber of claim 19 wherein the vertical conducting vias are of the same length, thereby providing the metal plates all at the same height.

21. The anechoic chamber of claim 19 wherein the array of metal plates comprises two sub-arrays, one array being higher than the other.

22. The anechoic chamber of claim 21 wherein metal plates in one sub-array overlap metal plates in the other sub-array.

23. The anechoic chamber of claim 19 wherein the height of all of the metal plates is adjusted at the same time.

24. The anechoic chamber of claim 19 wherein the height of each metal plate is adjusted independent of other metal plates.

25. The anechoic chamber of claim 24 wherein the height of each metal plate is adjusted using a microelectronic mechanical device.

* * * * *